US007350337B1

(12) United States Patent
Orosz

(10) Patent No.: US 7,350,337 B1
(45) Date of Patent: Apr. 1, 2008

(54) TILE PROTECTOR PLATFORM

(76) Inventor: Gabor w Orosz, 9236 Sapphire Point Ave., Las Vegas, NV (US) 89147

( * ) Notice: Subject to any disclaimer, the term of this patent is extended or adjusted under 35 U.S.C. 154(b) by 503 days.

(21) Appl. No.: 10/812,193

(22) Filed: Mar. 29, 2004

(51) Int. Cl.
*E04B 1/00* (2006.01)
*E04D 15/02* (2006.01)

(52) U.S. Cl. ..... 52/749.11; 52/747.11; 52/263; 52/DIG. 12

(58) Field of Classification Search ..... 52/DIG. 12, 52/747.11, 747.1, 747.12, 746.12, 749.11, 52/263, 177, 181, 126.6; 411/457, 461, 466, 411/427; 156/71; 47/65.9; 404/36, 37, 404/38, 43, 35; 119/529, 169, 471
See application file for complete search history.

(56) References Cited

U.S. PATENT DOCUMENTS 262,508 A 8/1882 Thomson
799,487 A 9/1905 Neice
800,655 A * 10/1905 Kitsee ..... 52/386
2,058,319 A * 10/1936 Jones ..... 52/745.1
2,441,580 A * 5/1948 Mageoch ..... 470/25
3,011,226 A * 12/1961 Menge ..... 411/466
3,104,429 A * 9/1963 Sanford ..... 411/468
3,157,254 A * 11/1964 Spiselman et al. ..... 52/263
3,281,168 A * 10/1966 Dufficy ..... 403/230
3,365,221 A * 1/1968 Jureit ..... 52/177
3,417,651 A * 12/1968 Moehlenpah ..... 411/466
3,417,652 A * 12/1968 Menge ..... 411/466
4,147,129 A * 4/1979 Ruplen ..... 119/28.5
4,359,849 A * 11/1982 Goeman ..... 52/479
4,489,448 A 12/1984 Cairo
4,593,499 A * 6/1986 Kobayashi et al. ..... 52/126.6
4,596,731 A * 6/1986 Cudmore et al. ..... 428/134
4,736,555 A * 4/1988 Nagare et al. ..... 52/126.6
4,744,194 A * 5/1988 Yasuyoshi ..... 52/747.11
5,116,179 A * 5/1992 Matlock ..... 411/466
5,119,904 A 6/1992 Dierolf
5,249,397 A 10/1993 Monaco
5,307,603 A * 5/1994 Chiodo ..... 52/698
5,364,204 A * 11/1994 MacLeod ..... 404/35
5,501,754 A * 3/1996 Hiraguri ..... 156/71
5,616,389 A * 4/1997 Blatz ..... 428/45
5,664,641 A 9/1997 Ritze
5,930,974 A * 8/1999 Zielinski ..... 52/747.11
6,256,952 B1 * 7/2001 Fahy et al. ..... 52/263
6,455,127 B1 * 9/2002 Valtanen ..... 428/137
6,601,361 B2 * 8/2003 Seibert ..... 52/698
2003/0042374 A1 3/2003 Johnson et al.

FOREIGN PATENT DOCUMENTS

CA 2.303.950 9/2001

* cited by examiner

*Primary Examiner*—Robert Canfield
*Assistant Examiner*—Jessie Fonseca
(74) *Attorney, Agent, or Firm*—Michael I Kroll

(57) ABSTRACT

The present invention 10 discloses a floor-tile platform 12 that is used with freshly laid tile 16 to allow walking on the floor 30 while the adhesive dries prior to applying the grout. The tile-like platform 12 is suspended over the tiled floor 16 by means of posts 18 situated within the grout lines 20. The tile platform 12 is comprised of a planar sheet having a plurality of apertures 14 passing therethough for the selective placement of posts 18 selectively placed in the tile platform to coincide with the location of grout lines 20. The tile platform 12 is then placed over the tiled floor with the posts 18 within the grout lines 20 thereby suspending the tile platform above the tiled floor 16.

8 Claims, 9 Drawing Sheets

TILE PROTECTOR PLATFORM

BACKGROUND OF THE INVENTION

1. Field of the Invention

The present invention relates generally to stands and, more specifically, to a floor-tile platform that is used with freshly laid tile to allow walking on the floor while the adhesive dries prior to applying the grout. The tile-platform is suspended over the tiled floor by means of posts situated within the grout lines. The tile-platform is comprised of a planar sheet having a plurality of apertures passing therethrough for the selective placement of posts selectively placed in the tile-platform to coincide with the location of grout lines. The tile-platform is then placed over the tiled floor with the posts within the grout lines thereby suspending the tile-platform above the tiled floor. The tile-platform can have a top surface of a frictional material to prevent slipping.

Furthermore, the present invention provides for an additional element in the form of a planar sheet having a plurality of punched extendable tabs that form the posts when bent in a downward fashion perform the similar function as the posts. In the preferred embodiment, the posts are threaded fasteners that are selectively screwed into the appropriate apertures.

2. Description of the Prior Art

There are other devices designed for tiles. Typical of these is U.S. Pat. No. 262,508 issued to Thomson on Aug. 8, 1882.

Another patent was issued to Neice on Sep. 12, 1905 as U.S. Pat. No. 799,487. Yet another U.S. Pat. No. 4,489,448 was issued to Cairo on Dec. 25, 1984 and still yet another was issued on Jun. 9, 1992 to Dierolf as U.S. Pat. No. 5,119,904.

Another patent was issued to Monaco on Oct. 5, 1993 as U.S. Pat. No. 5,249,397. Yet another U.S. Pat. No. 5,664,641 was issued to Ritze on Sep. 9, 1997. Another was issued to Johnson, et al. on Mar. 6, 2003 as U.S. Patent No. 2003/42374 and still yet another was issued on Sep. 5, 2001 to Marshall, et al. as Canadian Patent No. CA2303950.

U.S. Pat. No. 262,508

Inventor: William P. Thomson

Issued: Aug. 8, 1882

A roof-seat for shingling and other purposes provided with spikes or anchoring devices at either or both ends, and consisting of a front upright, a top adjustable on and over the upper end of the upright, and side braces connecting the upright with the top and adjustable along the top, substantially as specified.

U.S. Pat. No. 799,487

Inventor: James L. Neice

Issued: Sep. 12, 1905

A roof-bracket comprising a seat, angular supporting brackets at opposite sides of the seat, each supporting-bracket comprising a horizontal arm and a vertical leg, the arm being secured to the seat and provided with a spurred forward end, a brace extending diagonally between the arm and leg of each bracket, the brace being secured at its upper end to the arm, a transverse brace between the legs of the bracket, adjustable leg-sections slidably engaging the legs of the brackets and each provided with a pair of slots, a connecting and guide stud fastening the lower end of the diagonal bracket to the lower end of the leg and projecting through the lower slot in the leg and forming a fastening and guiding member therefor, a bolt passing through the leg section and adjoining end of the transverse brace and through the upper slot in the leg-section, whereby the bolt forms a fastening for the transverse brace and a guide and fastening for the leg section, and a nut upon the bolt for securing the same in adjusted position, whereby the leg-section is slidably mounted upon the leg.

U.S. Pat. No. 4,489,448

Inventor: John B. Cairo

Issued: Dec. 25, 1984

A foot support for use in a shower stall or bathtub enclosure during showering, whereon a person can rest or support his foot while applying soap thereto, the support including a series of indentation therein that confirm to a bather's foot, either left or right, wherein the foot is rested and supported as it is soaped, eliminating slippage thereof as it is pivoted and canted as it is washed.

U.S. Pat. No. 5,119,904

Inventor: Dave Dierolf

Issued: Jun. 9, 1992

Means and method are provided for walking on residential and commercial tile roofs with minimal breakage of the tile, there being a support provided having a planar backboard of plywood or the like with a pair of spaced, soft resilient parallel cushions on the front surface which are laid down into the troughs of the tile roof to distribute weight, and to distribute the weight particularly into the troughs of the roof, which are supported underneath by the sub-roof. The supports are distributed in a pathway over the roof to get the workman to the point on the roof that he needs to access, without stepping directly on the tiles.

U.S. Pat. No. 5,249,397

Inventor: Gary J. Monaco

Issued: Oct. 5, 1993

A knockdown roof platform for use on an inclined roof comprising a table structure an upper flat table top is disclosed. The table structure has a hollowed area on its underside. Struts are formed integral inside the hollowed area on an underside of the upper flat table top. An upright leg structure is positioned at one end of the table structure having an upper flat table surface positioned in a common plane with the upper flat table top. A hinge connects the table structure and the upright leg structure in assembly together. Collapsible locking brackets further secure the table structure and the upright leg structure in assembly. The collapsible locking brackets are being adjustable to secure the table structure and the upright leg structure in right angular relation thereby positioning the upper flat table top co-planar with the upper flat table top on the table structure. The collapsible locking bracket is releasable enabling the table structure and the upright leg structure to be pivoted on the hinge thus moving and collapsing the table structure and the upright leg structure out of right angular relation relative to one another and into a storage position where the table structure and the upright leg structure extend almost in parallel relation.

U.S. Pat. No. 5,664,641

Inventor: Donald E. Ritze

Issued: Sep. 9, 1997

A stair step assembly provides a safe means for mounting a peaked roof. Individual steps interlock with each other and with tiles of a tile roof so that the assembly cannot slide off the roof. Each step has a platform supported from below by a frame having a primary and secondary rest. The rests lie in contact with the roof and provide a foot constructed so that one portion of the foot is in contact with a vertical edge of a line of tiles to prevent the step from sliding.

U.S. Patent Application Publication Number 2003/42374

Inventor: Marvin D. Johnson, et al.

Issued: Mar. 6, 2003

A mounting assembly for securing a pedestal to a roof tile has a baseplate including a downwardly depending first hook at one end for receiving a first edge of the tile, an upwardly depending flange at an opposing end of the baseplate and a laterally extending stabilizer for engaging the surface of the tile. The mounting assembly includes a detachable bracket having an upwardly depending flange at one end and a downwardly depending second hook at an opposing end of the detachable bracket for receiving the second edge of the tile. The bracket is detachably coupled to the baseplate. The pedestal is secured to the baseplate.

Canadian Patent Number CA 2303950

Inventor: Dale Marshall, et al.

Issued: Sep. 6, 2001

A raised floor system for installation over a base floor that allows ready access to the space created thereunder. Raised floor panels are supported above the base floor by and secured to base floor web tile assemblies that interconnect one to another. Each base floor web tile assembly includes a plurality of hollow metal cylinders with a lower portion to which a plastic base floor web tile is over molded. The base floor web tile has adhesion pads with apertures which allow adhesive to be injected below the tile from above. The adhesive is used to affix the interconnected base floor web tile assemblies to the base floor. Further, an upper surface of each metal cylinder has over-molded thereto a plastic floor panel support boss. The floor panel support boss engages with a threaded panel fastener to secure a raised floor panel to a floor panel support of a base floor web tile assembly. Services such as telephone, electricity and computer cables may be installed in the space under the raised floor panels While these devices may be suitable for the purposes for which they were designed, they would not be as suitable for the purposes of the present invention, as hereinafter described.

SUMMARY OF THE PRESENT INVENTION

The present invention discloses a floor-tile platform that is used with freshly laid tile to allow walking on the floor while the adhesive dries prior to applying the grout. The tile-like platform is suspended over the tiled floor by means of posts situated within the grout lines. The tile platform is comprised of a planar sheet having a plurality of apertures passing therethrough for the selective placement of posts selectively placed in the tile platform to coincide with the location of grout lines. The tile platform is then placed over the tiled floor with the posts within the grout lines thereby suspending the tile platform above the tiled floor. The tile platform can have a top surface of a frictional material to prevent slipping. Furthermore, the present invention provides for an additional element in the form of a planar sheet having a plurality of punched extendable tabs that form the posts when bent in a downward fashion thereby performing a similar function as the posts. In the preferred embodiment, the posts are threaded fasteners that are selectively screwed into the appropriate apertures.

A primary object of the present invention is to provide a selectively locatable tile-platform for waking across a newly tiled floor while the adhesive dries.

Another object of the present invention is to provide a tile-platform that sits above the tiles without engaging the tiles.

Yet another object of the present invention is to provide a tile-platform having a plurality of apertures for the selective positioning of posts.

Still yet another object of the present invention is to provide the tile-platform with threaded apertures for insertion of threaded posts.

Another object of the present invention is to provide a tile platform having a top surface with frictional material to prevent slippage.

Yet another object of the present invention is to provide a tile platform having a plurality of punched extendable tabs that serve as posts.

Still yet another object of the present invention is to provide a tile-platform having posts that reside within the inter-tile grout lines.

Another object of the present invention is to provide a tile platform wherein a plurality of the tile-platforms can be used to cross any size of newly tiled floor.

Yet another object of the present invention is to provide a tile-platform that is easy to manufacture.

Still yet another object of the present invention is to provide a tile-platform that can be reused by repositioning the threaded posts.

Additional objects of the present invention will appear as the description proceeds.

The present invention overcomes the shortcomings of the prior art by providing a floor-tile platform that is used with freshly laid tile to allow walking on the floor while the adhesive dries prior to applying the grout. The tile-platform is suspended over the tiled floor by means of posts situated within the grout lines. The tile-platform is comprised of a planar sheet having a plurality of apertures passing therethrough for the selective placement of posts selectively placed in the tile-platform to coincide with the location of grout lines. The tile-platform is then placed over the tiled floor with the posts within the grout lines thereby suspending the tile-platform above the tiled floor. The tile-platform can have a top surface of a frictional material to prevent slipping.

Furthermore, the present invention provides for an additional element in the form of a planar sheet having a plurality of punched extendable tabs that form the posts when bent in a downward fashion perform the similar function as the posts, in the preferred embodiment, the posts are threaded fasteners that are selectively screwed into the appropriate apertures.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
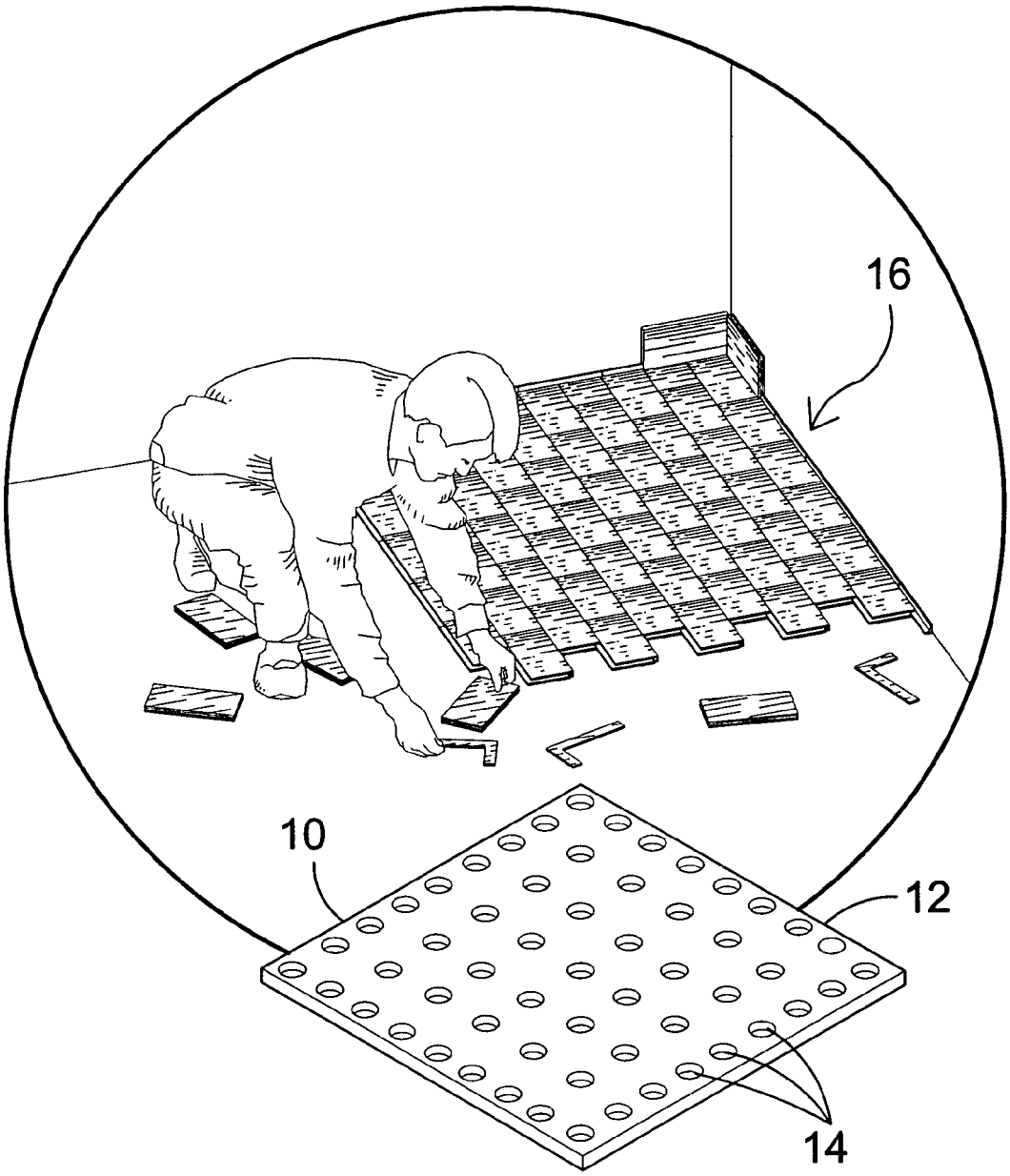
FIG. 1 is an illustrative view of the present invention.

With regard to reference numerals used, the following numbering is used throughout the drawings.

10 present invention
12 platform
14 apertures
16 tile floor
18 post
20 tile gap
22 threads
24 corner
26 post in down position
28 post in up position
30 floor

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10. The present invention 10 is a tile-platform 12 having a plurality of apertures 14 for the selective insertion of posts that when placed on a freshly laid tile floor 16, the posts extend into the grout lines holding the platform away from the newly tiled floor providing means for cross the newly tile floor without engaging the tiles. The tile-platform 12 is used to provide access to a newly tiled room 16 without disturbing or engaging the newly tiled floor.

Figure 2:
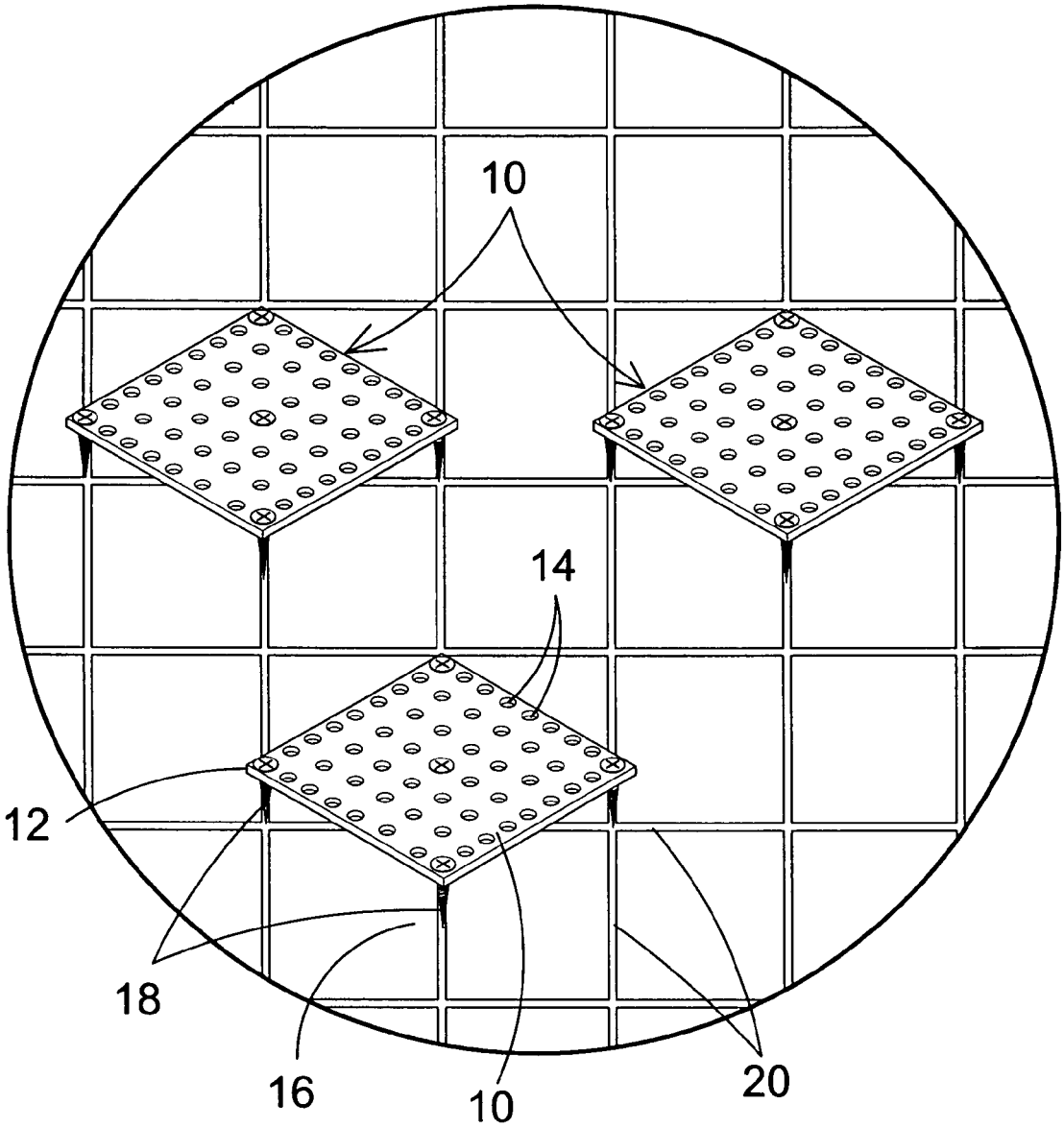
FIG. 2 is an illustrative view of the present invention in use.

Turning to FIG. 2, shown therein is an illustrative view of the present invention 10 in use. The tile-platform 12 has a plurality of apertures 14 which may be threaded, for the insertion of posts 18 that also may be threaded. Once the posts 18 are inserted, the tile platform 12 is positioned with the posts located within grout lines or gaps 20 (prior to grouting) in a non-tile engaging position. A plurality of the tile-platforms 12 can be used to provide access to any newly tiled 16 room, regardless of tile size, while the tile bonding agent dries. They 10 are easily removed when the grout is to be applied.

Figure 3:
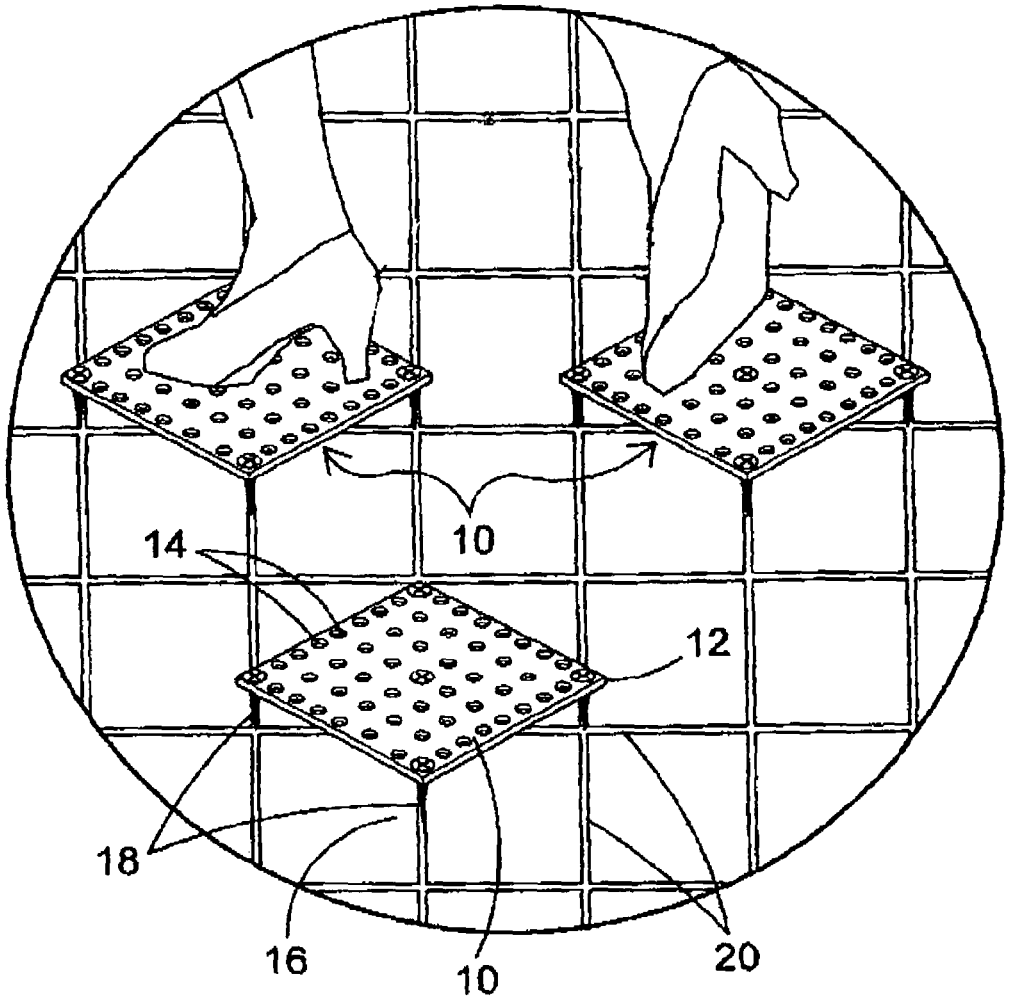
FIG. 3 is an illustrative view of the present invention in use.

Turning to FIG. 3, shown therein is an illustrative view of the present invention 10 in use. Shown is the present invention 10 comprising a platform or bridge 12 for supporting the weight of a user spaced away from a newly tiled floor 16, the platform having apertures 14 for selectively positioning posts 18 whereby the platform posts are selectively positioned in gaps 20 between various tile sizes, such as 6"×6", 8"×8", 12"×12", 13"×13", 16"×16", etc, preventing engagement therewith.

Figure 4:
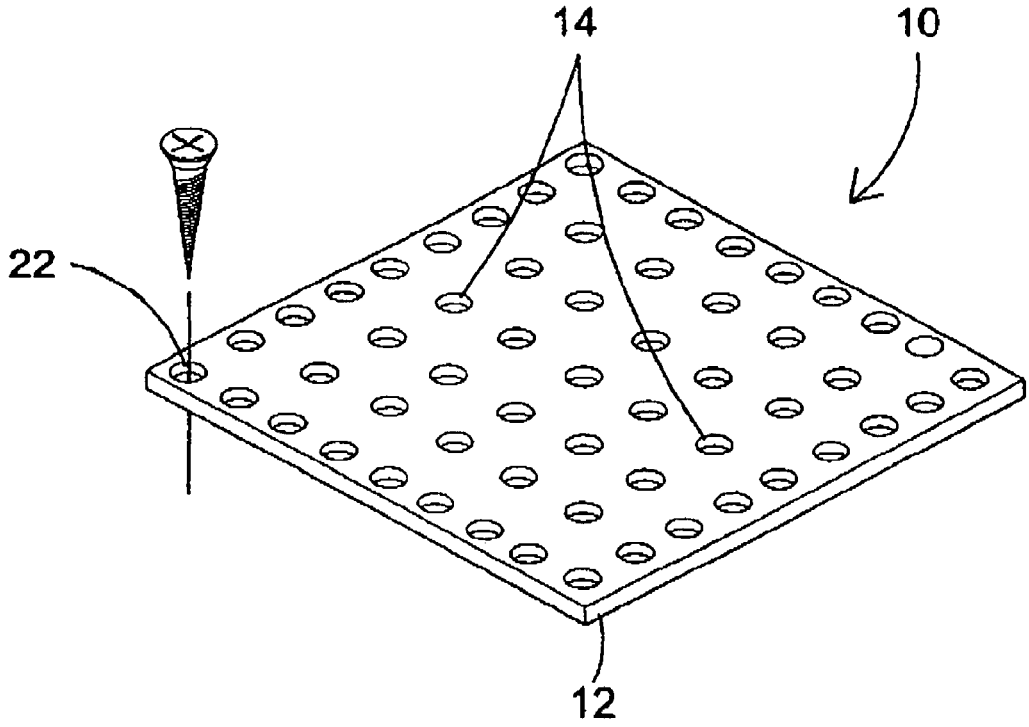
FIG. 4 is a perspective view of the present invention.

Turning to FIG. 4, shown therein is a perspective view of the present invention 10. Shown is a perspective view of the present invention 10 comprising a platform, or bridge 12 for supporting the weight of a user spaced away from a newly tiled floor, the platform having multiple apertures 14 that way be threaded at 22 for selectively positioning posts 18 that also may be threaded whereby the platform posts are selectively positioned between tiles preventing engagement therewith.

Figure 5:
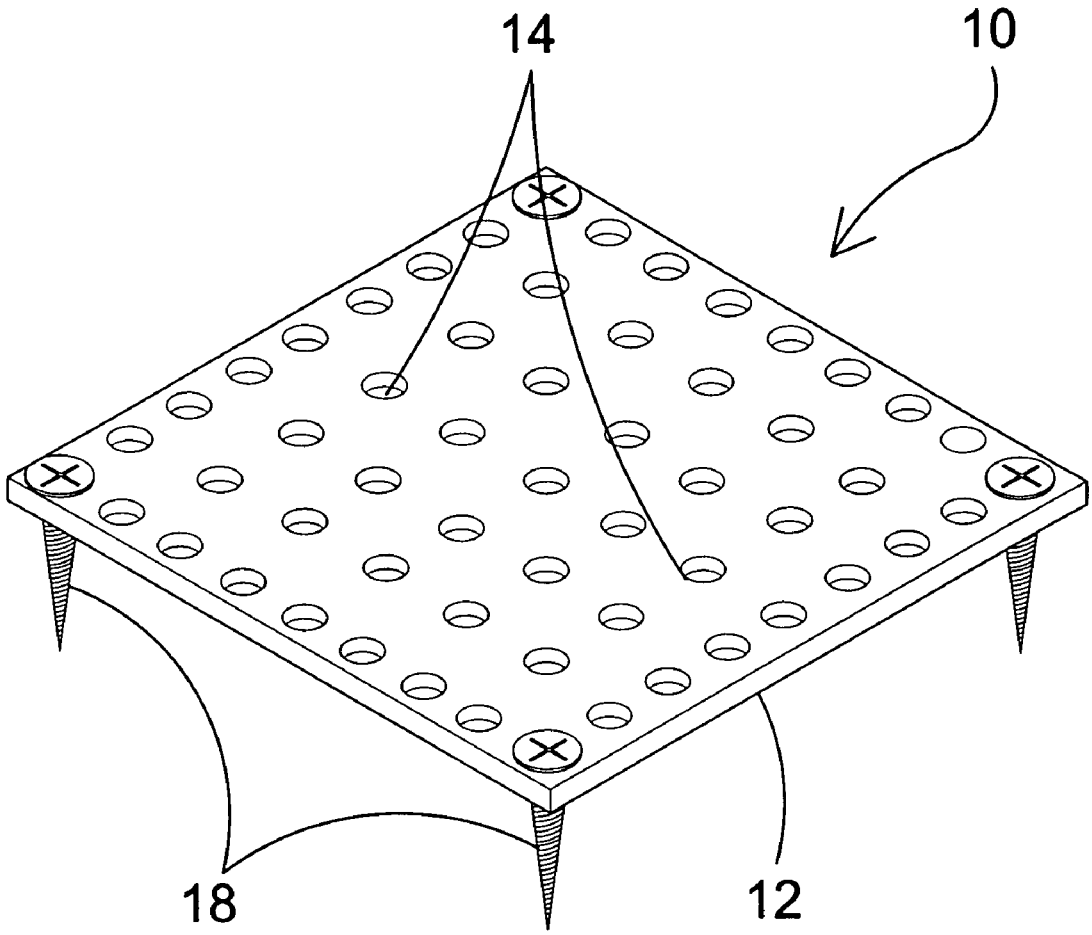
FIG. 5 is a perspective view of the present invention.

Turning to FIG. 5, shown therein is a perspective view of the present invention 10. Shown is an assembled tile-platform 12 having selectively positioned posts 18. The locations of the posts 18 are user selectable dependant on the size of the tiles being covered and the weight to be supported. The number of apertures 14 can vary as to size and position. The posts 18 can be conical in shape to fit between tiles having small grout lines.

Figure 6:
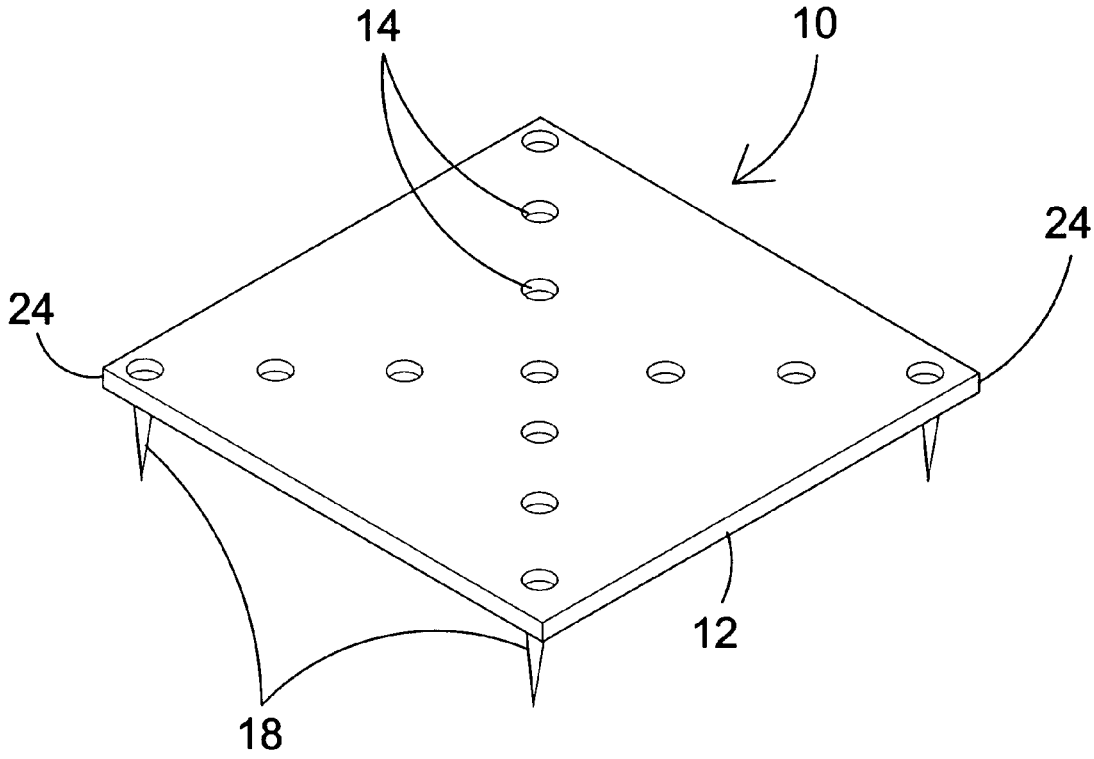
FIG. 6 is a perspective view of the tile-platform having a variation in aperture placement.

Turning to FIG. 6, shown therein is a perspective view of the tile-platform 12 of the present invention 10 having a variation in aperture 14 placement. Shown is an assembled tile-platform 12 having selectively positioned posts 18. The locations of the posts 18 are user defined dependant on the size of the tiles being covered and the weight to be supported. The number of apertures 14 can vary as to size and position. Another variation is illustrated of aperture positioning placing them diagonally from corner to corner 24. The posts 18 can be conical in shape to fit between tiles having small grout lines.

Figure 7:
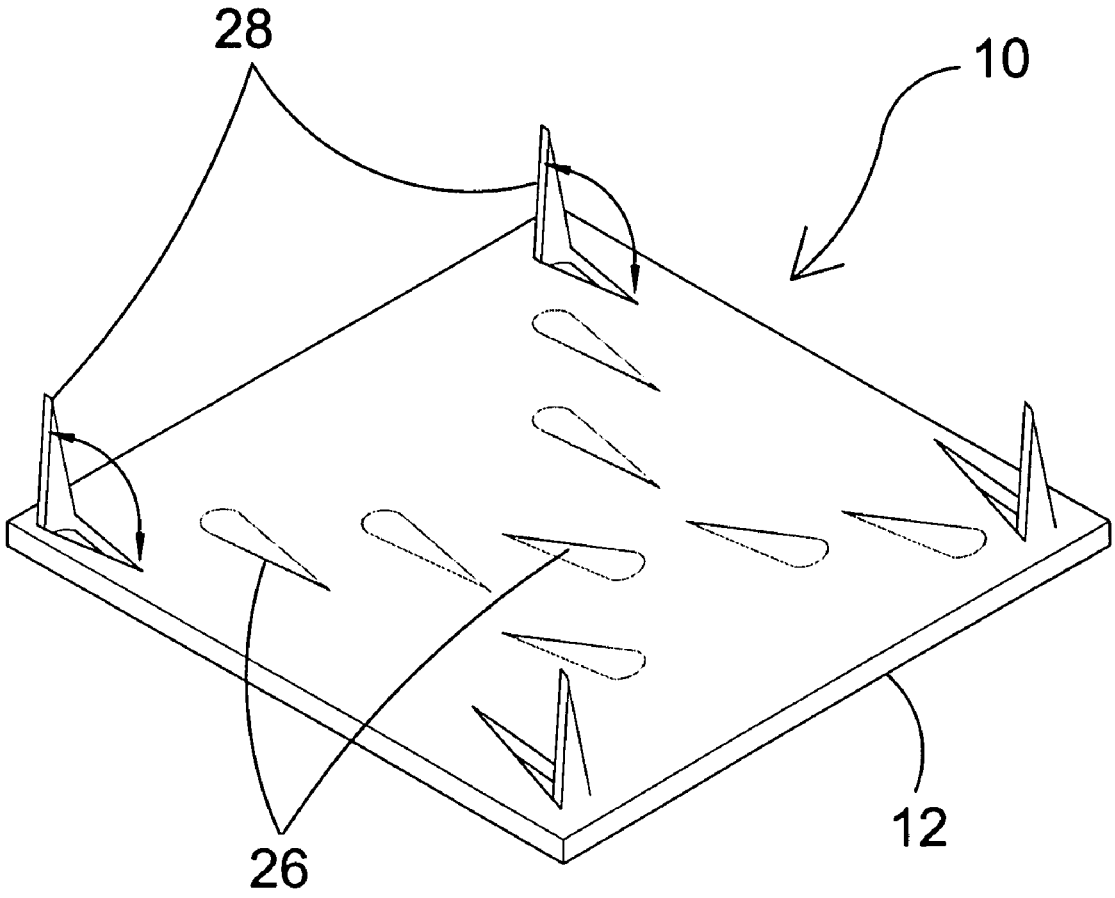
FIG. 7 is a bottom perspective view of an alternate tile-platform design.

Turning to FIG. 7, shown therein is a bottom perspective view of an alternate tile-platform 12 design of the present invention 10. Shown is a bottom perspective view of an alternate of the present invention 10 comprising a platform or bridge 12 for supporting the weight of a user spaced away from a newly tiled floor, the platform having bend down posts 26, 28 for selectively positioning posts whereby the platform posts are selectively positioned between tiles preventing engagement therewith. The bend down posts 26, 28 are manually and selectively bent and positioned by the user. Shown are posts in the down position 26 and in the up position 28.

Figure 8:
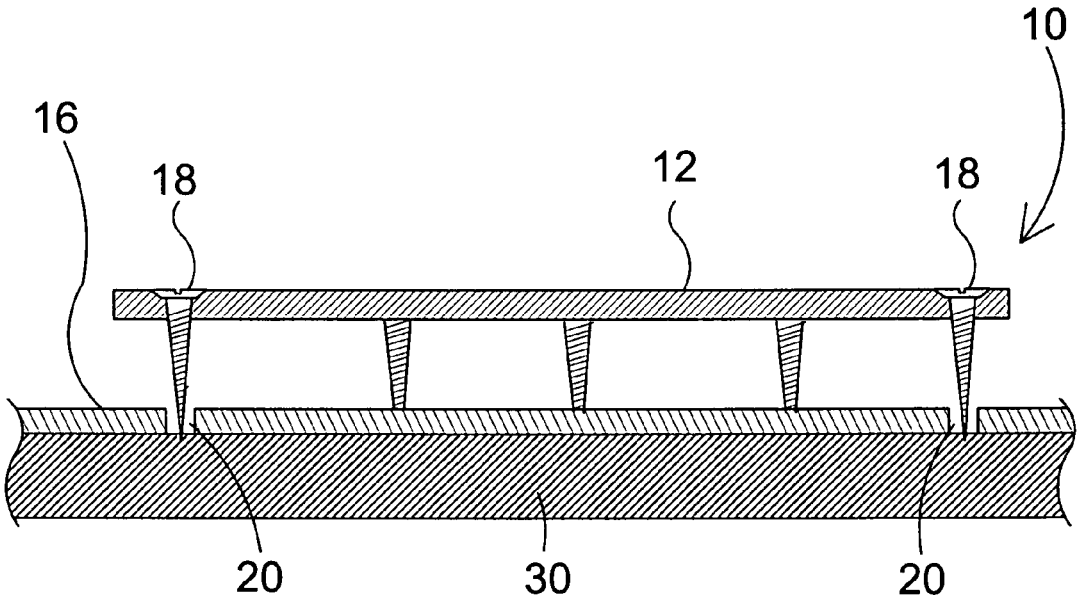
FIG. 8 is a sectional view of the present invention.

Turning to FIG. 8, shown therein is a sectional view of the present invention 10. Shown is a sectional view of the present invention 10 comprising a platform, or bridge 12 for supporting the weight of a user spaced away from a newly tiled floor 16, the platform having apertures for selectively positioning posts 18 whereby the platform posts are selectively positioned between tiles preventing engagement therewith. Also shown are the floor 30 and gaps 20.

Figure 9:
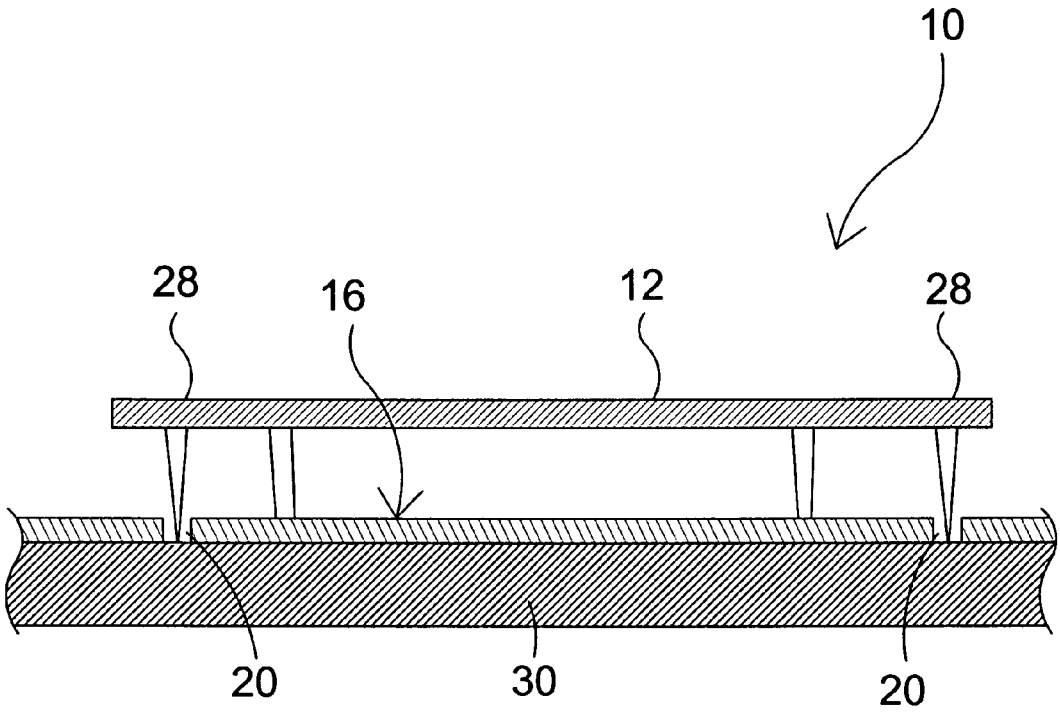
FIG. 9 is a sectional view of the alternate of the present invention.

Turning to FIG. 9, shown therein is a sectional view of the alternate of the present invention 10. Shown is a sectional view of the alternate design of the present invention 10 comprising a platform or bridge 12 for supporting the weight of a user spaced away from a newly tiled 16 floor, the platform having bend down posts 28 for selectively positioning posts whereby the platform posts are selectively positioned between tiles in gaps 20 preventing engagement therewith. Also shown is floor 30.

What is claimed is:

1. A tile protector platform assembly comprising:

a) a horizontal floor surface;

b) freshly laid floor tiles on said floor surface, said floor tiles having spaces therebetween for receiving grout;

c) a plurality of horizontal platforms above and spaced from said tiles;

d) each platform having a distributed pattern of spaced apertures;

e) said apertures being threaded;

f) a plurality of threaded, downwardly extending posts threaded through selected ones of said apertures located above said space with bottom ends of said posts resting for support on said floor surface between said tiles; and g) said platforms being distributed and spaced above said tiles whereby a user can walk on said platforms while not disturbing said tiles and are easily removed allowing grouting to be applied to said spaces.

2. The tile protector platform assembly of claim 1, wherein each said platform is rectangular shaped.

3. The tile protector platform assembly of claim 2, wherein said posts are disposed on corners of said rectangular shaped platforms.

4. The tile protector platform assembly of claim 3, further comprising a non-slip material being disposed on upper surfaces of said platforms.

5. A tile protector platform combination comprising:

a) a horizontal floor surface;

b) freshly laid floor tiles on said floor surface, said floor tiles having spaces therebetween for receiving grout;

c) a plurality of horizontal platforms above and spaced from said tiles;

d) each platform being flat; and e) a plurality of pre-punched tabs disposed on said platforms, a selected number of said tabs being bent downwardly and extending away from lower surfaces of said platforms and resting on said floor surface between said tiles maintaining said platforms above and spaced floor said floor tiles to enable a user to walk on said platforms without disturbing said tiles.

6. The tile protector platform combination of claim 5, wherein said platforms are rectangular shaped.

7. The tile protector platform combination of claim 6, wherein said tabs are disposed on corners of said rectangular shaped platforms.

8. The tile protector platform combination of claim 7, further comprising a non-slip material being disposed on upper surfaces of said platforms.

* * * * *